US008458908B2

(12) United States Patent
Fischer et al.

(10) Patent No.: US 8,458,908 B2
(45) Date of Patent: Jun. 11, 2013

(54) HAIR REMOVAL APPARATUS

(75) Inventors: Uwe Fischer, Darmstadt (DE); Xavier Perez-Lopez, Eschborn (DE); Robert Schmidt, Judenbach (DE); Andreas Larscheid, Kelkheim (DE)

(73) Assignee: Braun GmbH, Kronberg (DE)

( * ) Notice: Subject to any disclaimer, the term of this patent is extended or adjusted under 35 U.S.C. 154(b) by 389 days.

(21) Appl. No.: 12/522,285

(22) PCT Filed: Jan. 29, 2008

(86) PCT No.: PCT/EP2008/000650
§ 371 (c)(1),
(2), (4) Date: Dec. 11, 2009

(87) PCT Pub. No.: WO2008/092623
PCT Pub. Date: Aug. 7, 2008

(65) Prior Publication Data

US 2011/0005082 A1 Jan. 13, 2011

(30) Foreign Application Priority Data

Feb. 1, 2007 (DE) ..... 10 2007 005 853
Oct. 22, 2007 (DE) ..... 10 2007 050 380

(51) Int. Cl.
*B26B 19/26* (2006.01)
*B26B 19/38* (2006.01)
*B26B 21/40* (2006.01)

(52) U.S. Cl.
USPC ..... 30/34.1; 30/34.05; 30/50

(58) Field of Classification Search
USPC ..... 30/34.05, 34.1, 45, 47, 50, 335; D28/46
See application file for complete search history.

(56) References Cited

U.S. PATENT DOCUMENTS 3,969,819 A 7/1976 Pepera
4,322,885 A * 4/1982 Osada ..... 30/162
4,393,585 A * 7/1983 Nagelkerke ..... 30/34.1

(Continued)

FOREIGN PATENT DOCUMENTS

CA 2212561 2/1998
JP 50-30994 U 7/1973

(Continued)

OTHER PUBLICATIONS

U.S. Appl. No. 12/679,017, filed Oct. 9, 2008, Michael Maichel, et al.

(Continued)

*Primary Examiner* — Hwei C Payer
(74) *Attorney, Agent, or Firm* — Jerry J. Yetter; Kelly L. McDow

(57) ABSTRACT

The invention relates to a hair removal apparatus (100) having a base body (10) and a slide (20), which is mounted thereon to be movable (displaceably). At least one wet shaver unit (40) comprising a razor blade, such as a blade cartridge for wet shaving, is mounted on the slide. Due to the mobility of the slide (20), this wet shaver unit (40) is protected from damage in the event of impact of the hair removal apparatus, e.g., in a fall to the floor. Certain target positions of the slide (20) can be secured with a slip clutch, such that they become unlocked on exceeding a minimum force that is acting and thereby release a movement of the slide.

2 Claims, 3 Drawing Sheets

U.S. PATENT DOCUMENTS

| | | | | |
|---|---|---|---|---|
| 4,510,687 | A | 4/1985 | Groothuis et al. | |
| 4,558,517 | A * | 12/1985 | Gringer | 30/169 |
| 4,724,614 | A | 2/1988 | Wahl et al. | |
| 4,825,546 | A | 5/1989 | Araki et al. | |
| 5,497,553 | A * | 3/1996 | Chong | 30/162 |
| 5,502,896 | A * | 4/1996 | Chen | 30/162 |
| 6,052,905 | A * | 4/2000 | Branchinelli et al. | 30/50 |
| 6,101,721 | A * | 8/2000 | Medhurst | 30/125 |
| 6,192,586 | B1 | 2/2001 | Metcalf et al. | |
| 6,226,869 | B1 * | 5/2001 | Heintke et al. | 30/34.1 |
| 6,584,696 | B2 | 7/2003 | Ferraro | |
| 6,739,054 | B2 | 5/2004 | Oswald | |
| 7,100,286 | B2 | 9/2006 | Nakakura et al. | |
| 7,288,863 | B2 | 10/2007 | Kraus | |
| D568,534 | S * | 5/2008 | Micinilio et al. | D28/46 |
| D571,954 | S * | 6/2008 | Kling et al. | D28/46 |
| 7,434,317 | B2 * | 10/2008 | Levine et al. | 30/162 |
| 7,533,467 | B2 * | 5/2009 | Fossella | 30/162 |
| 7,536,787 | B2 * | 5/2009 | Blaustein et al. | 30/34.05 |
| 2002/0108252 | A1 | 8/2002 | Ferraro | |
| 2005/0217115 | A1 | 10/2005 | Blaustein et al. | |
| 2007/0006463 | A1 * | 1/2007 | Pennella | 30/34.1 |
| 2007/0180699 | A1 | 8/2007 | Psimadas et al. | |
| 2008/0016691 | A1 * | 1/2008 | Pennella et al. | 30/34.1 |
| 2008/0086887 | A1 * | 4/2008 | Park et al. | 30/29.5 |
| 2008/0184565 | A1 | 8/2008 | Zoot et al. | |
| 2009/0187523 | A1 | 7/2009 | D'Alo et al. | |
| 2010/0011585 | A1 * | 1/2010 | Maichel et al. | 30/34.1 |
| 2010/0139097 | A1 * | 6/2010 | Perez-Lopez et al. | 30/34.1 |
| 2010/0299927 | A1 * | 12/2010 | Fischer et al. | 30/34.1 |
| 2011/0016723 | A1 | 1/2011 | Maichel et al. | |
| 2011/0126412 | A1 * | 6/2011 | Perez-Lopez et al. | 30/34.1 |

FOREIGN PATENT DOCUMENTS

| | | | |
|---|---|---|---|
| JP | 54-16690 | U | 7/1977 |
| JP | 55-091670 | U | 6/1980 |
| JP | 56-100089 | A2 | 8/1981 |
| JP | 04-003667 | U | 1/1992 |
| JP | 2003-71155 | A | 3/2003 |
| WO | WO 95-10398 | | 4/1995 |

OTHER PUBLICATIONS

U.S. Appl. No. 12/679,909, filed Sep. 27, 2008, Uwe Fischer, et al.

* cited by examiner

HAIR REMOVAL APPARATUS

The invention relates to a hair removal apparatus having at least one wet shaver unit having a razor blade, in particular including a replaceable blade cartridge.

Blade cartridges for holding razor blades are known of wet shavers in particular. Damage to such blade cartridges, e.g., when the shaver falls to the floor, may release the blades and thus lead to a high risk of injury.

Against this background, the object of the present invention was to provide a safe-to-handle hair removal apparatus having such a wet shaver unit.

This object is achieved by a hair removal apparatus having the features of claim 1. Advantageous embodiments are contained in the dependent claims.

The inventive hair removal apparatus may comprise an electrically driven hair removal unit in particular, so that in this case the hair removal apparatus is a device combining an electrically driven shaver or hair clipper and a wet shaver unit. In general, the wet shaver unit may be operated both manually and electrically (in particular by means of a battery). It may thus be a wet shaver unit in which the blades are electrically driven to vibrate.

This hair removal apparatus comprises the following components:

a) A "base body" which typically comprises most of the total weight of the hair removal apparatus, i.e., more than 50%, preferably more than 80% of the total weight. In concrete terms, the base body may comprise in particular an electric motor and/or a battery and/or a foil shaver and/or a long hair clipper; these are relatively heavy parts whose weight can hardly be reduced below a certain minimum.

b) A slide mounted movably on the base body on which a wet shaver unit is or can be mounted. Such a wet shaver unit may be damaged due to impact forces, i.e., impact energy, if the hair removal apparatus falls to the floor. Due to the mobility of the slide, this wet shaver unit is protected from damage when there is a blow against the hair removal apparatus, e.g., due to falling to the floor.

The wet shaver unit may in particular comprise a replaceable blade cartridge holding one or more razor blades for a wet shaver. The blade cartridges for a shave must be arranged so they are exposed on the one hand while on the other hand they must be as small as possible, so they are highly at risk of damage due to impact. Empirical studies have shown that damage to such a blade cartridge occurs to an increased extent or even regularly at falling energies of 1.5-2.2 J (corresponding to a fall of 1.5 meter and a weight of the hair removal apparatus of approximately 100-150 grams). Damage may also occur to an increased extent with lower falling energies, so it is hardly possible to give a definite limit for the critical falling energy. In particular a critical falling energy naturally also depends on the exact embodiment of the wet shaver unit. However, the invention may also be used with lightweight hair removal apparatuses (such as plain wet shavers) to prevent damage that might occur due to the hair removal apparatus falling from a greater height or when the hair removal apparatus is thrown (the user slips and falls and the hair removal apparatus is thrown to the floor).

The movable support of the slide on the base body may in particular comprise a displaceably movable (translatory) support in which the slide can be displaced along an essentially straight or curved path relative to the base body. The slide with the wet shaver unit arranged on it may be embodied in particular so that when the hair removal apparatus falls to the floor, the slide is retracted out of an exposed position due to the impact forces, i.e., impact energy acting on it in at least one direction of action, into a position in which it is concealed by the base body; then the impact energy is absorbed mainly by the base body and the wet shaver unit remains undamaged. To displace the slide out of the exposed position, the acting force must have a component in the direction of movement of the slide from the exposed position into the concealed position. The force to be expended for retraction of the slide may be adjusted through the design in particular, so that hair removal with the wet shaver unit at typical contact forces with which a user presses the wet shaver unit against his face in the direction of movement of the slide does not lead to retraction of the slide.

The hair removal apparatus described here has the advantage of protecting a wet shaver unit connected to it, e.g., a blade cartridge, from damage because it is arranged on a movable slide. For example, if forces act on the wet shaver unit when it falls to the floor, these forces may induce a relative movement between the slide and the base body. This relative movement absorbs a portion of the impact energy so that it can no longer be converted to destruction of the wet shaver unit. Moreover, the relative movement prevents kinetic energy from being transmitted from the base body to the wet shaver unit, where it can result in damage. This aspect is especially important when the base body has a great weight in comparison with the slide and the wet shaver unit.

According to a preferred embodiment of the hair removal apparatus, the base body entirely or partially covers the wet shaver unit mounted on the slide in at least one position of the slide. In this position of the slide, the wet shaver unit is then protected from impacts from the covered directions due to the design of the base body. In particular if the use side of the wet shaver unit, i.e., the side on which the razor blade for the wet shaver is exposed, is also covered in the covered position, then the user can use the hair removal apparatus without having to fear that the blade could cut skin.

Catch elements that engage in at least one target position of the slide relative to the base body are preferably provided on the slide and the base body, thereby locking the slide in the target position. There are typically at least two target positions stabilized in this way (a starting position and an end position, such that the starting position may be the end position in which the wet shaver unit is concealed and the end position may be the position in which the wet shaver unit is arranged so it is exposed for use for wet shaving). Locking the apparatus in the target position achieves the result that the slide not only glides essentially freely (retarded only by frictional forces), but also it may assume certain use positions in a stable manner. For example, a blade cartridge mounted on the slide may be secured in an exposed position, in which it can be used for a wet shave. In addition, the slide may not only have the task of supporting the wet shaver unit movably on the base body but may also assume functions such as in particular a switch operation of electric components of the hair removal apparatus. The stabilized target position may thus correspond, for example, to the switch states "OFF," "LONG HAIR CLIPPER ON," "BEARD TRIMMER ON," etc.

In the exemplary embodiment described above, the slider preferably has an operating element such as a pushbutton by means of which the catch elements can be released (disengaged) by a user in a targeted manner when the slide is to leave the assumed target position.

According to a further embodiment of the hair removal apparatus with catch elements, the latter may become disengaged when a three greater than or equal to a predetermined minimum force (releasing force) acts on the slide in its direction of movement when in an exposed position (in other words, a position in which the wet shaver unit protrudes beyond the base body in the direction of movement of the slide), whereby the minimum force may be selected to be greater than the force at which a user presses the wet shaver unit against his skin during use. Thus, when forces act on the wet shaver unit and the slide when the hair removal apparatus falls to the floor, the component of these forces in the direction of movement of the slide from the exposed position into a concealed position being greater than the releasing force, the catch elements open (if they were previously engaged in a target position of the slide) and then enable a movement of the slide. The force producing the release should not result in destruction of the wet shaver unit, but is typically selected to be smaller than the minimum force required for damage (the latter may be determined in particular by empirical studies and/or FEM studies for a given hair removal apparatus). The fixation of the slide in a target position is thus designed to be loose enough so that the slide can still exert its desired protective effect for the wet shaver unit. The releasing force is typically in the range of 2N to 20N, especially 5N to 15N, and in particular more than 10N. Typical forces which occur in use of the hair removal apparatus (e.g., in wet shaving with a blade cartridge as the wet shaver unit) are in the range of less than 10N (e.g., 2N), so in this case the target positions of the slide are adequately stabilized during a normal use of the hair removal apparatus.

There are various possibilities for the concrete embodiment of the catch elements. According to a preferred exemplary embodiment, the catch elements comprise at least one recess in a sliding surface and at least one catch hook, which presses on the sliding surface in an elastic manner and can engage in the recess. The sliding surface with the recess is typically formed on the base body, while the catch hook is connected to the slide. However, the converse arrangement is of course also possible. With a relative movement between the base body and the slide, the catch hook moves along the sliding surface, whereupon it exerts a (light) pressure on it. When the catch hook reaches the position of the recess in the sliding surface, it can engage in the recess, yielding to the pressure exerted on it. To leave the recess, the elastic compressive force of the catch hook must be overcome, so this is possible only with an additional expenditure of force. In this way, the relative position between the base body and slide assumed in the recess is stabilized, i.e., locked.

In the extreme case, the catch hook may engage in the recess in the sliding surface described above in such a way that with a simple force acting on the slide in its direction of movement, the catch hook can no longer leave the recess without destruction (but instead requires targeted operation by a user, for example). For the desired protection of the wet shaver unit, as already explained, it is advantageous if an assumed target position is disengaged again on exceeding a certain releasing force. To achieve such an effect, the recess is preferably provided with at least one tapered surface inclined by an angle a to the sliding surface (and thus to the direction of movement of the slide) on which the catch hook can slide. The catch hook preferably has a contact surface which has a complementary shape and/or inclination and slides on the tapered surface. A force acting in the direction of movement of the slide is then converted into a force component acting in parallel to the tapered surface according to the angle of inclination a. If this force component is large enough (greater than the compressive force on the catch hook), then the catch hook can leave the recess and release further movement of the slide. Due to the angle of inclination of the tapered surface and the compressive force of the catch hook, the releasing force, which leads to opening of the catch element, may be adjusted in a targeted manner.

In the embodiment of the catch element as a recess and catch hook, two catch hooks are preferably provided on the ends of a U-shaped spring element, which can reach partially around the base body. A force acting symmetrically is achieved in this way, and a spring element can clamp itself more or less securely on the base body. In this context, a preferred embodiment is one in which the slide has a U-shaped cross section (as seen at a right angle to the direction of sliding) and in which it is provided with terminal sliding guides. The slide may then also be clamped more or less securely on the base body by a force acting symmetrically.

According to another refinement of the invention, the hair removal apparatus has a coupling for releasable connection of the wet shaver unit to the base body (directly or indirectly), such that the force and/or energy required to release the coupling with respect to at least one given direction of action is greater than a given minimum force and/or minimum energy. With the help of the coupling, a supplementary protection of the wet shaver unit from damage is achieved because it is simply separated from the hair removal apparatus when certain (not yet destructive) forces/energies are exceeded and therefore it no longer participates in the conversion of its kinetic energy into destructive energy.

The invention is explained in greater detail below on the basis of an exemplary embodiment of a hair removal apparatus with reference to the figures, in which FIG. 1 shows an inventive hair removal apparatus in a) a resting position of the slide, b) a first switch stage of the slide, and c) another switch stage of the slide;

Figure 1:
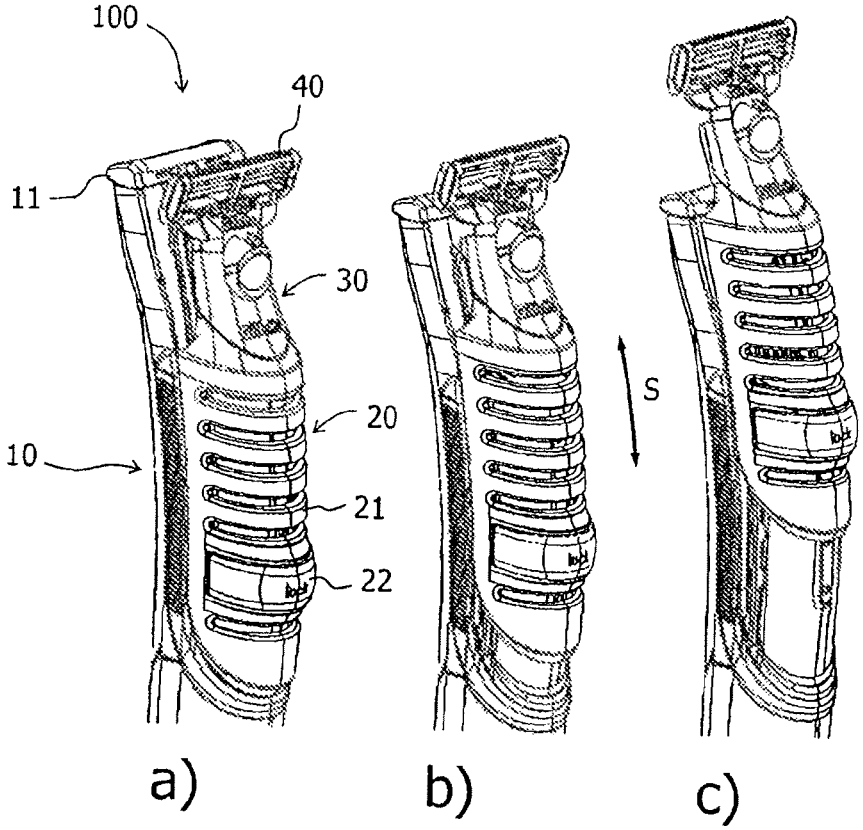
FIG. 1 shows a perspective view of an exemplary hair removal apparatus 100 comprising a combination of a long hair clipper and a wet shaver, said combination comprising the following components.

- A base body 10 with a long hair clipper 11 attached at the head end; the base body 10 has an electric motor and typically also a battery (not shown).
- A slide 20 with a sliding body 21, which is mounted so it is displaceably movable on the base body 10 in the direction of movement S, and a manual release button 22, which engages in predefined target positions and thereby locks the slide 20. The base body 10 and the slide 20 together form the "main unit" of the hair removal apparatus 100.
- A wet shaver unit 40 in the form of a blade cartridge in which one or more parallel blades for a wet shaver are fixedly mounted. The blade cartridge 40 is connected to the slide 20 indirectly by means of an intermediate element 30.

The hair removal apparatus 100 shown here combines means for an electric shaver and/or an electric hair trimmer with means for a wet shaver. One problem in the design of such a device is that the wet shaver unit 40 must be protected from damage, which could be incurred with a fall from a typical height of approximately 1.5 meter. Damage that is not directly visible but could result in injury in subsequent use of the wet shaver unit 40, e.g., because of protruding blades, would be especially critical in this regard.

With the hair removal apparatus 100 shown here, damage to the wet shaver unit would occur because its weight together with that of the motor and battery may amount to approximately 100-150 grams, which in the case of a fall from a height of 1.5 meter would frequently or regularly result in damage to the blade cartridge, as shown by empirical studies. For this reason, the measures explained in greater detail below are proposed for protection of the wet shaver unit 40 (in particular a blade cartridge) from damage in falling to the floor.

An important first safety mechanism for the wet shaver unit 40 is achieved by mounting it on the slide 20, which may assume a lower target position (FIG. 1*a*), a middle target position (FIG. 1*b*) and an upper (exposed) target position (FIG. 1*c*) relative to the base body 10, but the middle position does not have any great relevance for the safety function. In the lower target position of FIG. 1*a*, the wet shaver unit 40 is retracted and is thereby protected with respect to the covered impact directions by the long hair trimmer 11 of the base body 10 in the event of a fall. In particular the use side, i.e., the side on which the razor blades are freely exposed, is covered by the base body. A user can then use the long hair trimmer safely without having to fear that the wet shaver unit 40 could cause cuts.

In the middle and upper target positions of FIGS. 1*b* and 1*c*, the wet shaver unit 40 protrudes away from the base body 10 in an exposed manner. This is necessary so that it can be used for a wet shave. In this target position, protection of the wet shaver unit 40 is achieved by the fact that the slide 20 can yield an impact and may move approximately into the lower target position of FIG. 1*a* (the slide can also move from any exposed position into an intermediate position, which is stabilized by catch elements and in which the wet shaver unit need no longer absorb the impact energy, but instead in the event of an impact, the base body of the hair removal apparatus absorbs the impact energy). However, it is problematical here that in the embodiment shown here, the upper and middle target positions that are shown must be locked with respect to the forces occurring in normal use (typically less than 10N, especially approx. 1-4N and in particular 2N) without thereby losing the desired safety function due to retraction of the slide in impact. In this regard, a concrete implementation of the slide mechanism is described in greater detail below with the help of FIGS. 2 to 6. It should be pointed out here that the figures usually show only one side of the hair removal apparatus, which is designed essentially in mirror image with respect to a central axial plane.

Figure 2:
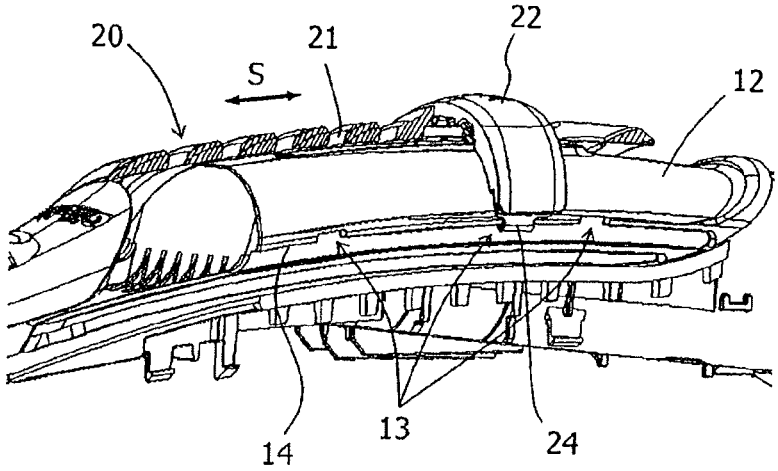
FIG. 2 shows a side view of the top shell of the base body, which is cut open axially, with the slide attached.

Of the base body 10, FIG. 2 shows only a top shell 12, which is connectable to a bottom shell (not shown). The slide 20 with the sliding body 21 (shown in a sectional view) and with the release button 22 is mounted on the top shell 12, thus being displaceably movable in direction S. In addition, slightly curved guide rails with sliding surfaces 14 extending longitudinally are provided on opposite sides of the top shell 12, the U-shaped curved sliding body 21 with complimentary sliding webs (not shown) reaching under the sliding surfaces. Three recesses 13 are provided in each sliding surface 14 such that a catch hook 24 can engage in them to stabilize the target positions of the slide 20 defined by the recesses 13.

Figure 3:
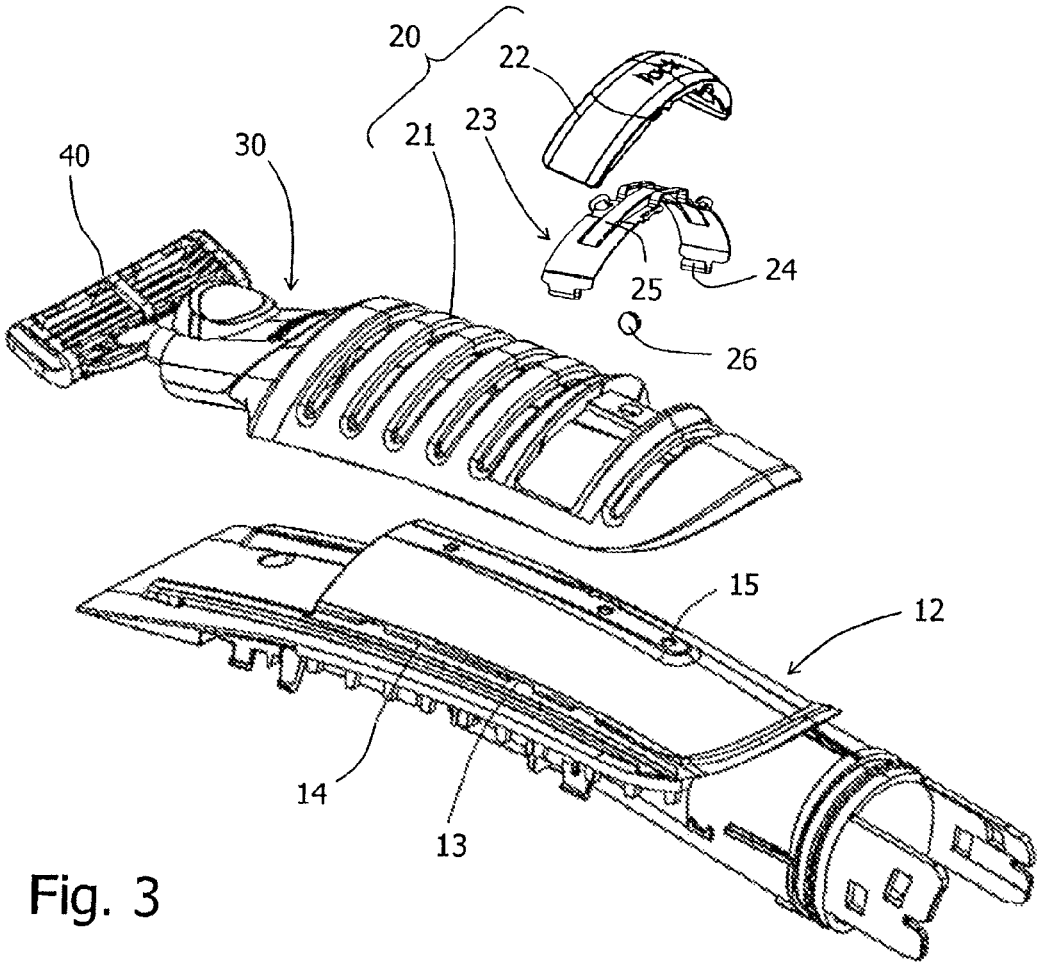
FIG. 3 shows an exploded diagram of the top shell, the slide and the locking device of the hair removal apparatus.

FIG. 3 shows the components of FIG. 2 again in an exploded diagram, showing

- the top shell 12 with one of its sliding surfaces 14 in which three recesses 13 are formed;
- the curved U-shaped sliding body 21 with the intermediate element 30 attached to it by a releasable coupling, supporting the wet shaver unit 40;
- the release button 22 with the U-shaped spring element 23 beneath it, made of a spring elastic metal, catch hooks 24 formed on the ends thereof in mirror image (in the installed state, the spring element 22 is fixedly clamped on the release button 22);
- a ball bearing 26, which presses from beneath against spring webs 25 on the spring element 23 in the installed state and engages in holes 15 on the top shell 12 when the slide 20 is in a predefined target position.

Figure 4:
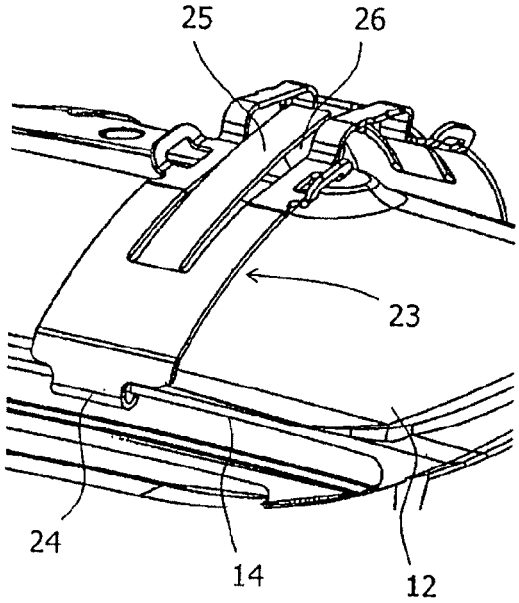
FIG. 4 shows an enlarged perspective view of the spring element placed on the top shell.
Figure 5:
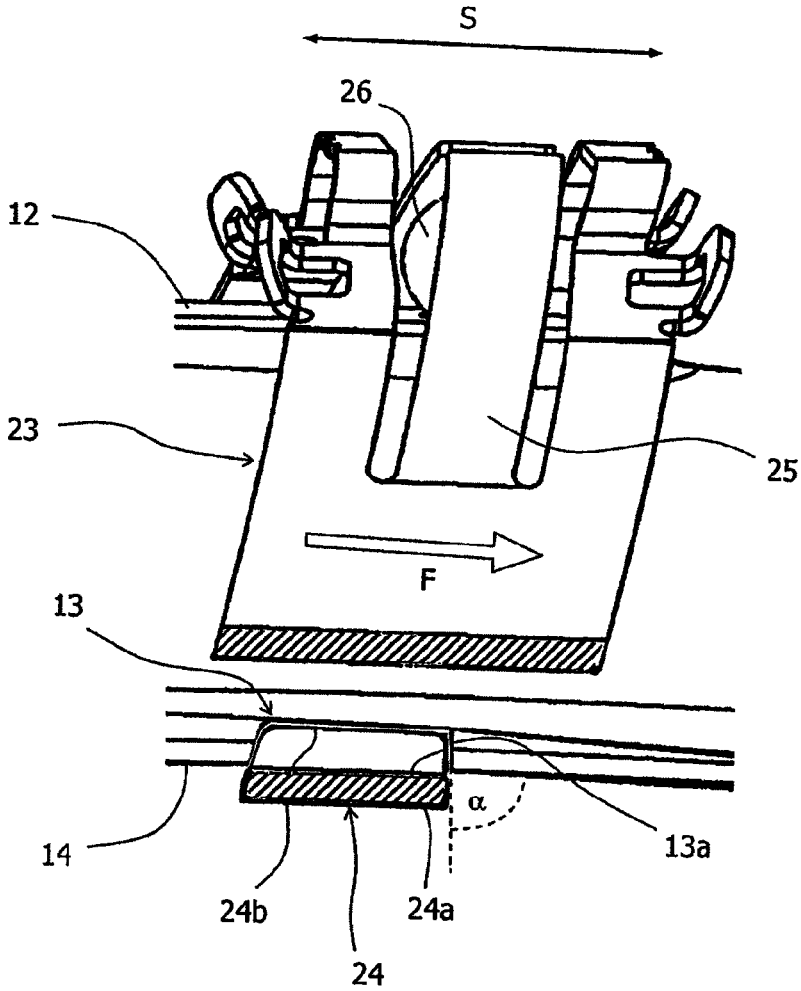
FIG. 5 shows a view according to FIG. 4 from another direction, whereby the spring element is cut in the area of the catch hook, and the catch hook engages in a recess on the shell.
Figure 6:
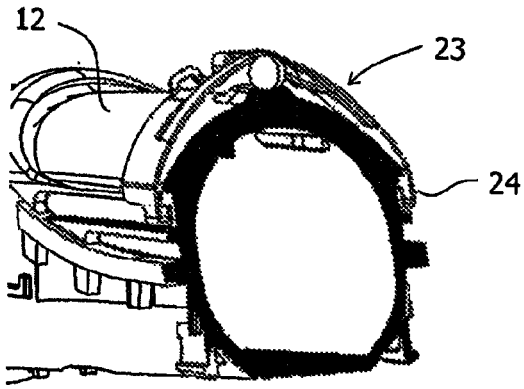
FIG. 6 shows a cross-sectional view of the top shell with the spring element attached.

FIGS. 4, 5 and 6 show the details of the engagement of the spring element 23 in the recesses 13 in the sliding surfaces 14 on the top shell 12 in various diagrams. According to this, the catch hooks 24 are designed as inwardly directed bends in the ends of the spring element 23, the top edge 24*b* of which slides on the sliding surfaces 14 of the top shell 12. The spring element 23 is pressed away from the top shell 12 by the spring webs 25 and the ball 26, thus creating a compressive force of the catch hooks 24 on the sliding surfaces 14. Following this compressive force, the catch hooks 24 can enter into the recesses 13 in the sliding surfaces 14 when the slide reaches the axial position. Further movement of the slide is thereby initially blocked. The recesses 13 and the catch hooks 24 thus constitute catch elements that cooperate and lock certain target positions of the slide 20.

The release of the catch connection described here may be accomplished by a user selectively by exerting pressure on the release button 22, this pressure being transmitted to the spring element 23 and lifting the catch hook 24 out of the recesses 13.

In addition, the catch connection may also be lifted when a large enough force F acts in the direction of movement S of the slide 20. In this regard, tapered surfaces 13*a* are discernible on the recesses 13 in FIG. 5, which form an angle $\alpha$ to the sliding surfaces 14 (and thus to the direction of movement S of the slide) and along which a contact surface 24*a* of the catch hooks 24 can slide. The angle $\alpha$ is in the (open) interval from 0° to 90°, preferably between 45° and 90°, depending on the releasing force F above which release is to occur. With the typical dimensions of the spring force of the spring element 23 and with an angle $\alpha$=45°, the releasing force (in the direction of sliding S) is approximately 15N. On the other hand, the forces that occur in shaving are in the range of approximately 2N, so there cannot be any inadvertent release in normal use of the hair removal apparatus.

Thus, in summary, a type of slip clutch acting in the translatory direction S is implemented on the hair removal apparatus 100, being deployed on exceeding a certain releasing force, thus enabling a movement of the slide 20. A release button 22 serves to manually displace the slide 20 by depressing it as needed. Based on the compressive force acting on the spring element 23, the catch hooks 24 situated on the side thereof are automatically pressed into the recesses 13 on the base body (without operating a button). The releasing force at which the slide 20 can be pushed back even without operation of the release button 22 can be adjusted in a targeted manner by the angle $\alpha$ of the tapered surfaces 13*a* of the recess 13 and of the side faces 24*a* of the catch hook 24 in combination with the spring force. This force, which occurs in particular with an impact on the slide, is selected (low) so that the slide begins to move before the wet shaver unit would be damaged. On the other hand, the force is selected to be greater than the forces that occur in wet shaving, in order to be sure that the slide 20 is not unintentionally pushed back while shaving.

The edges of the recesses 13 may optionally also be designed in conjunction with catch hooks 24, so that in an impact (the first time) the catch hooks 24 cut an inclined tapered surface into the material of the top shell 12, along which they can leave the recesses 13. For example, this is possible if the top shell 12 is made of a suitably soft plastic and the spring element 23 is made of thin sheet metal.

To protect the blade cartridge 40 in the middle and top target positions of FIGS. 1*b* and 1*c* from damage in an impact, according to a second safety mechanism, an intermediate element 30, which sits between the wet shaver unit 40 and the slide 20 and/or the slide body 21, may also be provided. The wet shaver unit 40 is relatively securely attached to the intermediate element 30 by a special (standardized) connection. To replace the wet shaver unit 40, the user may operate a pushbutton to release a connecting mechanism, which is not explained further here.

For the desired additional protection of the wet shaver unit 40, a coupling designed between the slide 20 and the intermediate element 30 is important, its thickness being such that it opens with forces and/or energies below the minimum forces and/or minimum energies that would result in damage to the wet shaver unit 40 (certain unfavorable directions of fall might be excluded from this protective effect). Therefore, if the hair removal apparatus 100 falls on the wet shaver unit 40, the intermediate element 30 with the wet shaver unit 40 is released from the slide 20 and thus also from the base body 10, so the kinetic energy of the base body 10 can no longer lead to damage to the blade cartridge 40. The releasing force for the coupling must be of such a dimension that the stresses for the wet shaver unit 40 remain within a range that does not result in damage, while on the other hand, the intermediate element 30 is not inadvertently released from the slide 20 during normal shaving.

If falling of the hair removal apparatus 100 leads to a safety release of the intermediate element 30 with the wet shaver unit 40, the user can than simply press on the intermediate element 30 like a pushbutton and push it onto the slide 20.

The invention described above on the example of an exemplary hair removal apparatus 100 may similarly also be used with other hair removal apparatuses, in particular with heavy devices such as mechanical wet shavers with steel handles or wooden applications, in wet shavers with battery operation or with traditional devices comprising an electrically driven shaver or hair trimmer and a wet shaver, which may also be battery operated.

What is claimed is:

1. A hair removal apparatus (100) comprising:

a) a base body (10) on which an electrically driven hair removal apparatus unit is fixedly arranged, said base body comprising a member selected from the group consisting of an electric motor, a battery, a foil shaver and combinations thereof, and b) a slide (20), which is movably mounted on the base body and on which a we shaver unit (40) having at least one razor blade is mounted or to which it can be connected mechanically, and wherein the slide (20) enables the wet shaver unit (40) to be displaced out of an exposed position to at least one position in which the wet shaver unit (40) is at least partially concealed by the base body (10), said hair removal apparatus (100) comprising catch elements (13, 24), wherein th catch elements (13, 24) are provided on the base body (10) and the slide (20), and engage in at least one target position of the slide (20) relative to the base body (10) thereby locking the slide (20) in the target position with a locking force, said catch elements comprising two catch hooks; wherein said two catch hooks (24) are arranged on the ends of a U-shaped spring element (23) which extends partially around the base body (10) and wherein the force needed to displace the wet shaver unit out of the exposed position is such that the contact force with which a user presses the wet shaver unit against his face in the direction of movement of the slide does not lead to movement of the slide.

2. A hair removal apparatus (100) comprising:

a) a base body (10) on which an electrically driven hair removal apparatus unit is fixedly arranged, said base body comprising a component selected from the group consisting of an electric motor, a battery, a foil shaver and combinations thereof, and b) a slide (20), which is movably mounted on the base body and on which a wet shaver unit (40) having at least one razor blade is mounted or to which it can be connected mechanically; and wherein the slide (20) enables the wet shaver unit (40) to be displaced out of an exposed position to at least one position in which the wet shaver unit (40) is at least partially concealed by the base body (10); said hair removal apparatus (100) further comprising catch elements (13, 24), wherein the catch elements (13, 24) are provided on the base body (10) and the slide (20), and engage in at least one target position of the slide (20) relative to the base body (10) thereby locking the slide (20) in the target position, said catch elements comprising two catch hooks; wherein said two catch hooks (24) are arranged on the ends of a U-shaped spring element (23) Which extends partially around the base body (10); wherein the wet shaver unit (40) is coupled to the slide (20) by an intermediate element (30) which is released with the wet shaver unit from the slide, said release being effected by a dropping force that does not damage the wet shaver unit.

* * * * *

UNITED STATES PATENT AND TRADEMARK OFFICE

CERTIFICATE OF CORRECTION

PATENT NO. : 8,458,908 B2
APPLICATION NO. : 12/522285
DATED : June 11, 2013
INVENTOR(S) : Uwe Fischer et al.

It is certified that error appears in the above-identified patent and that said Letters Patent is hereby corrected as shown below:

In the Claims:

Column 8, Line 4, delete "we" and insert --wet--.

Signed and Sealed this
Thirtieth Day of July, 2013

Teresa Stanek Rea

Teresa Stanek Rea
*Acting Director of the United States Patent and Trademark Office*